United States Patent [19]

Hundley

[11] Patent Number: 4,763,899

[45] Date of Patent: Aug. 16, 1988

[54] WARM-UP BAT

[76] Inventor: W. Maynard Hundley, 2614 36th St., SW., Grand Rapids, Mich. 49509

[21] Appl. No.: 694,701

[22] Filed: Jan. 25, 1985

[51] Int. Cl.[4] ..... A63B 69/40

[52] U.S. Cl. ..... 273/26 B; 273/186 A; 273/DIG. 8

[58] Field of Search ..... 273/26 B, 29 A, 72 R, 273/72 A, 183 D, 186 A, 193 R, 193 A, DIG. 8, 87.4; 272/137

[56] References Cited

U.S. PATENT DOCUMENTS

| | | | |
|---|---|---|---|
| 3,414,260 | 12/1968 | Gust | 273/29 A |
| 3,452,990 | 7/1969 | Nichols | 273/DIG. 8 |
| 3,955,816 | 5/1976 | Bratt | 273/26 B |
| 4,118,033 | 10/1978 | Miyamoto | 273/186 A |
| 4,326,716 | 4/1982 | LaCoste | 273/DIG. 8 |
| 4,343,467 | 8/1982 | Newcomb et al. | 273/72 R |
| 4,399,996 | 8/1983 | Boyce | 273/26 B |

*Primary Examiner*—Richard C. Pinkham
*Assistant Examiner*—T. Brown
*Attorney, Agent, or Firm*—John A. Waters

[57] ABSTRACT

A flexible weighted device for the purpose of practice or warm-up formed from a moldable plastic resin with an integrally molded weight at an outer portion and a stiffening device at an inner end. The configuration simulates a bat or the like with standard dimensional appearance with a grippable handle and an outer portion designed to strike a ball. The bat has a flexible intermediate portion with sufficient resiliency to bend and discharge substantial amounts of inertial momentum at the end of a swing, thereby preventing injury to the user.

15 Claims, 2 Drawing Sheets

WARM-UP BAT

BACKGROUND OF THE INVENTION

This invention relates to a flexible weighted bat or the like formed from a moldable plastic resin with an integrally molded stiffening and reinforcing member and in a configuration that simulates a bat or the like of standard dimensional appearance.

In baseball and softball it is customary for the athlete to practice or warm-up with a standard bat with additional donut-shaped weights attached. One of the problems with the standard bat is that the donut-shaped weight can fly off the end of the bat, thereby creating a safety hazzard. Another drawback to this device is that there is no flex at the end of the practice swing, and the extra weight on the bat increases the danger that the muscles, tendons or ligaments of the athlete swinging the bat can be stretched, torn, or damaged, particularly at the end of the swing where the momentum of the bat is to be stopped.

Another type of known warm-up bat employs a solid handle and a hollow chamber at the outer portion of the bat, with the chamber being filled with a number of materials that will supply additional weight, thus making this device heavier than the standard bat. This style of warm-up bat also is inflexible and causes the bat to retain its momentum at the end of a practice swing. The potential for injury to the athlete is therefore still present.

Other types of devices for various sports, such as golf or tennis, employ bendable or articulated shafts for practicing swing timing, the shaft requiring correct timing for proper club movement. These devices weight about the same as a normal club and do not employ extra heavy weights for weight training. The shafts of such clubs generally are designed to buckle or bend radically when the swing is improper and not deflect resiliently.

The present invention overcomes the long standing problems attributed to the donut shaped weight customarily used with the standard bat as a warm-up device and provides a weighted warm-up device that incorporates sufficient flex to reduce injury.

SUMMARY OF THE INVENTION

The present invention comprises a flexible device for the purpose of practice or warm-up, made of a moldable plastic resin and formed with itegrally molded weighting and stiffening devices. One configuration of the device appreciably simulates a bat with standard dimensional appearances such that it has a grippable handle portion and an outer portion with proportions of length and diameter representative of the standard baseball or softball bats.

The stiffening device employed is a tubular shaft centered throughout a considerable portion of the length of the bat and positioned such that it commences near the inner end of the bat. The point at which the stiffening shaft terminates is determined by the degree of flexibility desired. The portion of the bat that is left unstiffened relies upon the moldable plastic resin for its strength, resiliency, and other characteristics.

The weighting device employed is typically a solid cylinder of lead or other dense material. Like the stiffening device, the weighting apparatus is placed along the axial centerline of the bat but unlike the stiffening device, the weight is located in the outer portion of the bat. The weight is totally encased in the moldable plastic resin so as to impart a cosmetically acceptable appearance.

The stiffening and the weight devices are joined by a connector that is integrally formed with both in the bat form. This connector restrains the weight and keeps it from separating from the bat while in use. By anchoring one end of the connector in the tubular stiffening device, the user is assured of a safe construction. The connecting member is typically placed in the mold that forms the weight device. This technique allows the material that ultimately becomes the weight to permeate and contact the connector and affirmatively ensuring adhesion thereto.

DETAILED DESCRIPTION OF THE PREFERRED EMBODIMENT

Figure 1:
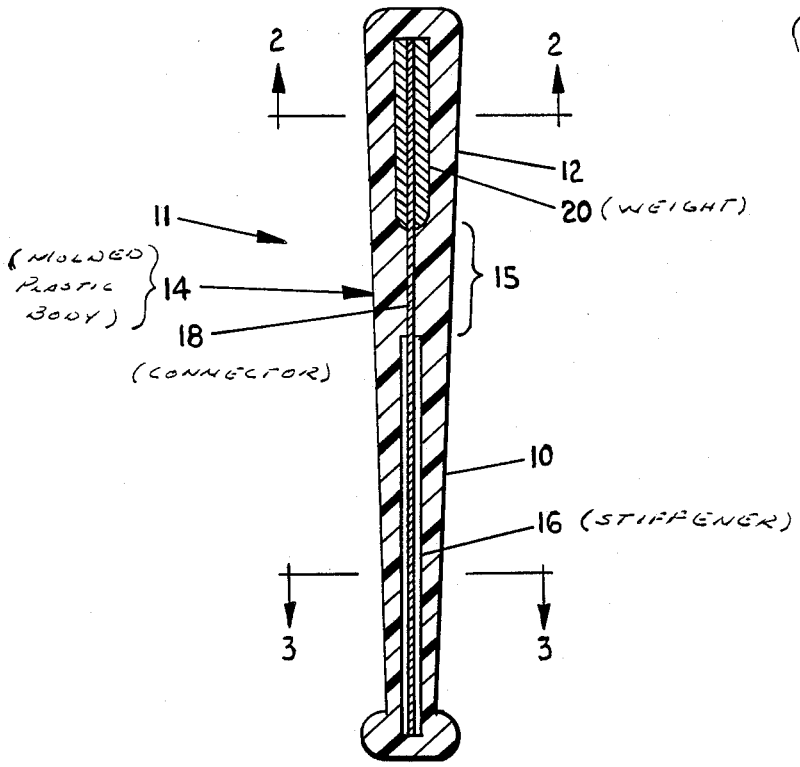
FIG. 1 is a side cross-sectional view of the bat showing the relationship of the bat form with the stiffening, connecting, and weight means.

Referring now to the drawings, a flexible weighted practice bat 11 is shown in FIG. 1. The bat handle comprises an elongated body with handle portion 10, and an outer portion 12 adjacent an outer end. The typical bat profile is shown wherein the handle portion is used as the portion of the bat gripped by the athlete such that when the bat is swung the blunt end traverses an arc with the ultimate object being the contact of the outer portion with a ball.

The bat itself is comprised of a molded plastic body 14 formed in the shape of a bat or other implement being simulated. The choice of plastic is quite important because the plastic resins must exhibit the requisite characteristics of strength, flexibility, and resiliency. The preferred plastic is a moldable polyurethane. This produces a bat with the sufficient flexibility, resilience, and durability for the desired functions of the bat, while providing low cost construction. A solid polyurethane is desired as opposed to foam, because foam can break easily, particularly if the skin is broken. Also, foam is not as desirable from a resiliency and toughness standpoint, which is important in a weighted bat. When the bat is being formed in the mold, it is important to observe that in the filling process that the resin flood the bat chamber thoroughly and preferentially from the handle end 10. Excess plastic resin may be allowed to escape from the blunt outer end 12 in order to ensure that the mold is sufficiently free of air and filled with resin such that the final product configuration is the same as that dictated by the mold cavity. It has been demonstrated that the curing time involved when molding plastics and in particular polyurethane is dependent on temperature. The temperature of choice to initiate curing in this invention is 140° F. Under these conditions and with a polyurethane resin, it is possible to achieve cure times as low as 3 seconds. Other combinations of plastic resins and copolymers are known and may be employed to produce a similar product.

The internal construction of the flexible weighted bat is shown in FIG. 1. The bat includes an integrally molded stiffener 16 axially positioned in the handle end of the bat. A connector 18 is attached to the stiffener and extends along the axial center line of the bat from the handle portion towards the outer end and is attached to a weight 20. In the preferred mode, the stiffener is a semi or substantially rigid tube formed from aluminum tube stock with a ⅝ inch outer diameter and about a ½ inch inner diameter. The aluminum tube is placed into the mold prior to filling and is suspended into the appropriate alignment by pins inserted in the cavity of the mold for that purpose. The edge of the stiffener is placed ½ inch from the inner edge of the handle portion 10 of the bat in the preferred case. The outer end of the aluminum tubular shaft terminates at a point spaced apart from the weight, leaving an intermediate portion 15 of the bat between the stiffener and the weight wherein the flex characteristics are determined by the length of the intermediate portion and the thickness and durometer of the plastic. The degree of resiliency of the bat is tailored to the prospective user such that the bat will deflect through a 70 to 110 degree angle at the end of a normal swing, preferably a 90 degree angle. With a greater angle the bat can hit the back of the player. A smaller angle of deflection indicates a bat that is stiffer than desired. Such a bat will not cushion the momentum of the bat as much as is desired. The end of the bat will sag about 15° to 25° when held horizontally at rest. While the force of a normal swing will produce a resilient bat deflection of about 70°–110°, the bat can be forcibly bent manually a full 180° if enough force is applied without breaking the bat.

The aluminum tubing that comprises the stiffener 16 is sized appropriately to accept the connector 18, which is typically composed of a stranded cable. The cable of choice is a seven strand steel cable and has a 500 pound test capability. Stainless steel cable is also suitable. The typical diameter of such a steel cable in a 500 pound test is approximately 3/16 inch, thus making the diameter of the connector a small portion of the diameter of the bat. Noting that the function and purpose of the connector is to keep the weight 20 from separating from the molded plastic body 14, the use of a connector may not be critical in a bat with a durable body. The successful criteria in the selection of a suitable connector really rests primarily on its tensile strength and its bendability or flexibility. The resiliency of the bat (i.e., the spring-like tendency of the bat to resist deflection and to return to its unstressed position after bending) is provided predominantly by the plastic body of the bat.

Proceeding towards the outer portion of the bat, the outer end of the aluminum tubular shaft is spaced apart from the weight, exposing the connector 18 at the intermediate portion 15 of the bat before it is imbedded into the weight 20. It is this point at which the articulation of the bat takes place. Generally two to five inches and preferably 3½ to 4½ inches of such exposure of the connector is sufficient to impart enough flexibility to the bat for the desired purpose, with the length of the intermediate portion being dependent on the length of bat. For instance, in a junior sized bat, the length of the intermediate portion may be reduced somewhat. Desirably the bat is about one and one-half to two inches in diameter at the intermediate portion and has a durometer of 50–80 and preferably about 70–75.

The weight 20 located in the outer portion 12 serves to provide the necessary resistance for the warm-up purpose. Typically the weight is a high density material and in the standard size and configuration will weigh about 1½ to 2½ pounds, with the lighter weight being for the junior bat and the heavier weight being for adults. Desirably the bat with the weight is about 1½ to 2½ times and preferably twice the normal weight of the bat the person would normally use. This criteria is used for all warm-up devices, not just the bat. The preferred material of choice for the weight is lead. The lead weight is about one inch in diameter and is integrally formed with the embedded connector. The cable that comprises the connector is inserted into a discrete molding device used to form the weight. Molten lead is poured into that cavity and it permeates and contacts all of the surface area of the connector. When solidified, this forms a bond between the two thus ensuring the safety purposes of the connector will be fulfilled. The end of the weight 20 is about one inch from the exterior edge of the outer end 2 of the bat. The weight is thus completely covered and surrounded by the moldable plastic resin, thus imparting a cosmetic appearance to the finished product.

In a typical bat for high school usage with a 30 inch length, the connector length is approximately 29 inches and the bat weighs four pounds, with the weight weighing one and one-half pounds. In a bat designated for professional or collegiate use, the overall length is typically 33 inches with a connector cable 32 inches in length. The bat weighs five pounds, with the weight weighing two and one-half pounds. A similar style warm-up bat for use in little league or girl's softball has an overall length of 27 inches, a connector cable length of 26 inches, and a weight of three pounds, with the weight weighing one pound.

Figure 2:
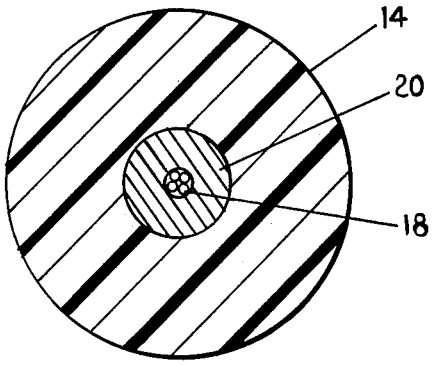
FIG. 2 is an axial cross-section taken along line 2—2 of FIG. 1.

In FIG. 2, the cross-section of the bat through the weight 20 is shown. The core of the bat at this point is connector 18 encased by the weight 20. Both are shown completely surrounded by the molded plastic body 14. In the usual case, the weight is surrounded by a thickness of about one-half inch of the plastic body. The actual amount is dependent on the various proportions attributed to different lengths of the bat. The weight and connector should be axially centered as much as is possible. Any large deviations in the centering of the weight could detract from the warm-up function.

Figure 3:
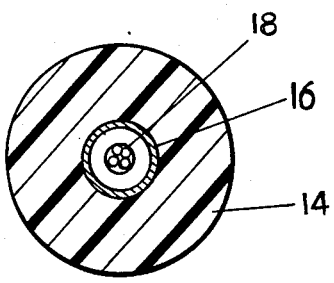
FIG. 3 is an axial cross-section of the bat taken along line 3—3.

The cross-sectional view shown in FIG. 3 is taken from a portion of the handle portion 10 of the bat. The connector 18 is shown inside the stiffener 16. In between the two is a gap 22 which is filled with the same resin that comprises the molded plastic body 14. During the molding process, resin is forced through the gap so as to contact and permeate all the filaments of the cable making up the connector. When fully cured, the resin found in the gap will form a mechanical bond between the stiffener and the connector. This acts as the anchor point for restraining the weight.

Figure 4:
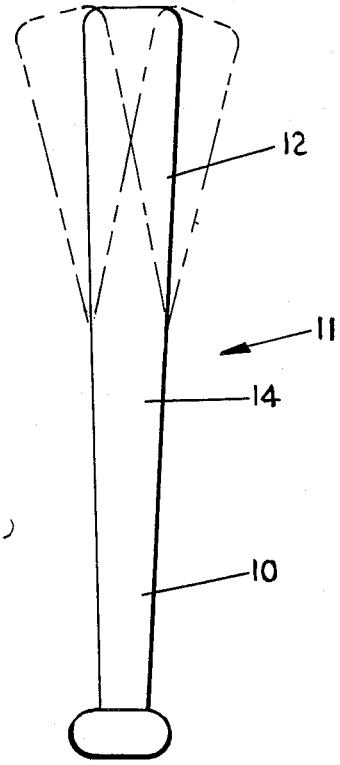
FIG. 4 is a side elevational view showing the action of the flexible portion of the bat in phantom.

The flexible action of the bat is highlighted in FIG. 4. In use, the bat travels an arc with the handle end at the center and the outer end at the radius. The forces generated at the outer end could normally work to the detriment of the user. The inertia created by the swinging of the bat has to be countered by some force and in the traditional method, it is the batter's own muscles, tendons, and ligaments that are used to oppose it. Through the use of a bat with sufficient resiliency, the increased inertial momentum present in a weighted bat can be discharged by the bat itself, thus providing the batter with the requisite amount of warm-up value without risking injury. Thus it can be seen that with all of the elements of the invention cooperating together a unique and valuable action is generated with an increase in overall safety.

While the present invention is particularly well suited for use as a warm-up bat for baseball or softball, the principles of the present invention can be employed in the construction of a warm-up device for other sports employing a hand held implement having a handle extending outwardly to an outer portion that is used to strike a ball or other object by swinging the implement. Tennis and golf are two such sports. Weight training devices for these sports are shown in FIGS. 5–8. Is is important to understand that these devices are not intended merely as swing timing devices wherein articulated or bendable shafts are employed for training purposes. Rather, the outer portion of these devices is substantially heavier than the outer portion of a tennis racket or golf club (about 1½ to 2½ times as heavy and desirably about twice as heavy) and the flexible intermediate portion of the handle does not buckle or bend radically to indicate a poor stroke but merely resiliently bends a sufficient amount (about 70 to 110 degrees, preferably 90 degrees) at the end of a normal swing to cushion the change in momentum of the heavily weighted end of the device.

Figure 5:
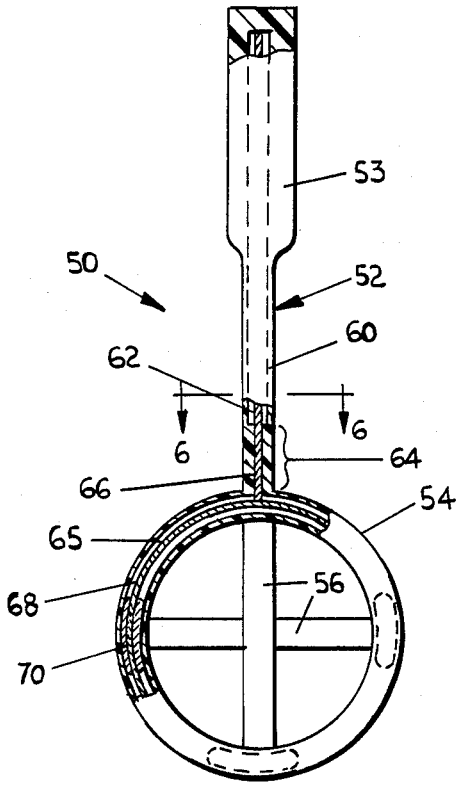
FIG. 5 is a partially sectional view showing the warm-up device shaped in the form of a tennis racquet.
Figure 6:
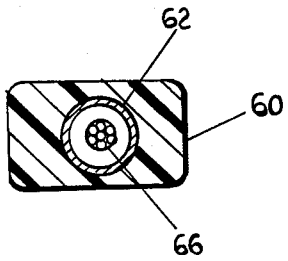
FIG. 6 is a sectional view taken along line 6—6 of FIG. 5.

Referring to FIG. 5, a weighted warm-up device for tennis 50 comprises an elongated handle 52 integrally molded with a circular outer portion or head 54 having integrally molded cross braces 56. The entire unit is integrally molded of polyurethane as in the construction of the warm-up bat. Handle 52 comprises an enlarged hand grip portion 58 comparable to a size of the hand grip of a tennis racket. A more narrow portion or neck 60 of the handle extends from the hand grip to the head 54. As shown in FIG. 6, the neck is substantially rectangular as in a conventional tennis racket and is desirably about 1 inch wide by ¾ inches thick. A stiffener tube 62 of the same type employed in the bat is integrally molded in axial alignment in the handle, with the tube extending from an inner end about ½ inch from the inner end of the racket to an outer end spaced apart from the head of the racket. An intermediate portion 64 of the handle is positioned between the outer end of the tube and the head.

Head 54 comprises a circular tubular member 65 of substantially the same construction as tubular member 62. This tubular member is integrally molded in the device during the molding process. Integrally formed cross members 56 are solid polyurethane.

Connector cable 66 extends longitudinally from the inner end of the handle through the tube and into contact with another connector cable 68 running in a circular pattern through tube 65. Cables 66 and 68 are conventional stranded steel cable of the same type employed in the bat. The cable is integrally bonded in tubes 62 and 65 by the polyurethane during the molding of the body, as in the bat. The use of a separate bonding agent such as epoxy or the like which fills the tubing surrounding the cable is an alternative.

Lead weights 70 are integrally molded to cable 68 at symmetrically spaced locations separated by 90° angles about the head, with one weight being positioned at the end of the racket and two other weights being separated from the first weight by 90° on each side of the head.

The principal flex provided in the tennis racket training device occurs at intermediate portion 64. As in the bat, the flex and resiliency of the intermediate portion is such that the tennis racket generally holds its shape but flexes resiliently to cushion muscle stress at the end of the swing of a tennis racket. Desirably a polyurethane resin having a durometer of 60–90 and preferably 80–85 is employed in the tennis racket. This gives the racket sufficient rigidity to easily swing the racket while providing sufficient resiliency to cushion the change in momentum at the end of a swing.

Figure 8:
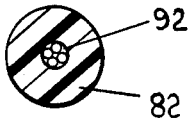
FIG. 8 is a sectional view taken along line 8—8 of FIG. 7.
Figure 7:
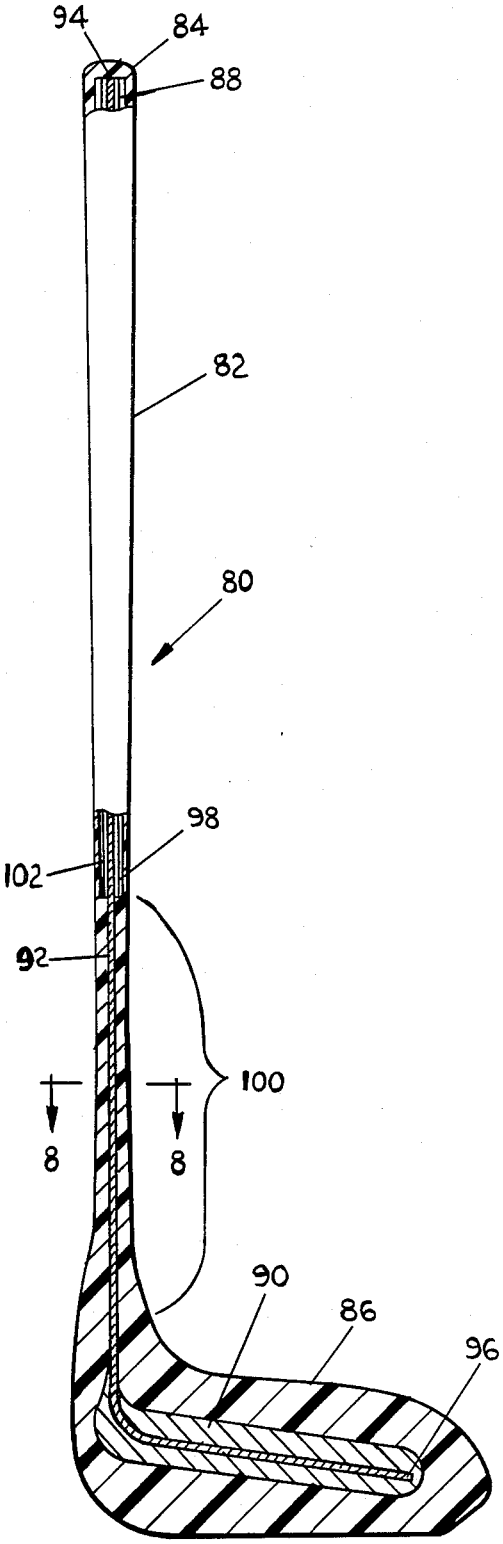
FIG. 7 is a partially sectional view showing a warm-up device formed in the shape of a golf club.

A golf club 80 constructed in accordance with the present invention is shown in FIG. 7 and 8. Golf club 80 comprises an elongated handle 82 extending from an inner end 84 where the club is gripped to an outer end that attaches to a head 86 shaped in the shape of a golf club head. The entire unit, like the other practice devices, is integrally formed of molded polyurethane. A stiffener 88 is integrally molded in the handle in axial alignment therewith. A semi-flexible metal golf club shaft is desired as a stiffener in this application. This shaft is considered also to be semi-rigid or substantially rigid when compared with the flexibility of the intermediate portion.

A lead weight 90 generally in the shape of a golf club head is integrally molded in outer portion or head 86 of the training device. The lead weight is substantially heavier than the normal weight of the head of a golf club, since the the golf club is used for weight training purposes. Desirably this club should be about 1½ to 2½ times and preferably twice the weight of a conventional golf club.

A connector cable 92 extends from an inner or upper end 94 adjacent the inner end of the club through tube 88 and to an outer end 96 integrally molded in the lead weight. A conventional stranded steel cable of the type used for the bat and tennis racket is satisfactory for this purpose.

Tube 88 terminates at an outer end 98 spaced apart from lead weight 90, leaving an intermediate portion 100 between the outer end of the stiffener tube and the lead weight. Intermediate portion is the primary area where the flex of the golf club head occurs.

As shown in FIG. 8, the intermediate portion comprises primarily the resilient polyurethane body of the training device, with the polyurethane surrounding the cable preferably being about ¼ inch thick. To provide sufficient stiffness so that the club generally holds its shape but deflects sufficiently to cushion the change in the momentum at the end of a swing, the body of the club desirably is formed of polyurethane having a durometer of 85–95 and preferably 90–95. This is higher than the durometer of the bat, because of the thinner diameter of the intermediate portion of the club in comparison with the bat.

As in the bat and tennis racket, the connector cable is bonded to the tubular shaft by means of the polyurethane during the molding process. The connector provides tensile strength while the polyurethane provides resilience to the device.

It should be noted that the foregoing embodiments of the present invention are merely exemplary of the preferred practice of the invention and that various modifications and changes may be made in the arrangements and details of construction without departing from the spirit and scope of the present invention, as defined in the appended claims.

I claim:

1. A warm-up bat comprising:

an elongated body integrally molded from a resilient, moldable plastic resin, the bat including an elongated handle portion extending outwardly from an inner end of the bat towards an outer portion adjacent the outer end of the bat;

a weight integrally molded in the outer portion of the bat, the weight rendering the bat substantially heavier than a conventional bat;

an elongated stiffener integrally molded in the handle portion of the bat, the stiffener being an elongated shaft axially positioned in the handle portion and extending from an inner end adjacent the inner end of the bat to an outer end spaced apart form the weight by a predetermined distance, leaving an intermediate portion of the bat between the stiffener and the weight, the intermediate portion being resilient and flexible such that when the bat is swung, the bat resiliently bends and casues the weighted outer portion to gradually decelerate at the end of the swing, thus cushioning momentum and minimizing damaging muscle stress on the person swinging the weighted bat while still providing weight training and flexibility exercise; and a flexible elongated connector integrally molded in the bat and interconnecting the stiffener and the weight, the connector providing tensile strength and restraining the weight from becoming separated from the handle portion, the connector being a cable attached to the weight at one end and attached to the shaft at the other end.

2. A warm-up bat according to claim 1 wherein the length of the intermediate portion and the thickness and resilience of the bat at the intermediate portion are such that the end of the bat sags about 15°–25° at rest and deflects through an angle of about 70°–110° at the end of a normal swing to cushion the change in momentum of the weighted outer portion.

3. A warm-up bat according to claim 1 wherein the bat has a durometer of about 50–80 at the intermediate portion.

4. A warm-up bat according to claim 3 wherein the bat is formed of polyurethane resin and the intermediate portion has a durometer of about 70–75, the bat being about 1½ to 2½ inches in diameter at the intermediate portion.

5. A warm-up bat according to claim 1 wherein the shaft is a tube and the cable is of smaller diameter than the internal diameter of the tube, the cable extending into the tube and being anchored therein by the resin, the resin filling the tube and surrounding the cable during the molding process, thus holding the cable in the tube.

6. A weighted warm-up bat comprising:

an elongated body integrally molded from a polyurethane resin in the shape of a bat, the bat having an inner end and an outer end and an outer portion adjacent the outer end, the bat being about 2 inches thick at the outer end thereof and gradually tapering toward the inner end thereof, the body having a handle portion extending from the inner end toward the outer portion;

an elongated lead weight integrally molded in axial alignment with the bat in the outer portion thereof, the lead weight being about 1–3½ pounds in weight;

a stiffener integrally molded in the handle portion of the bat, the stiffener comprising a substantially rigid aluminum tube having a ⅝ inch outer diameter, the tube being axially aligned with the handle portion of the bat and extending from an inner end adjacent the inner end of the bat to an outer end spaced away from the weight, the space between the outer end of the tube and the weight constituting an intermediate portion of the bat;

a cable interconnecting the tube and the weight, the cable comprising a stranded metal cable approximately 3/16 inch in diameter, the cable having an outer end integrally molded in the lead weight and an inner end that extends into the aluminum tube to a point adjacent the inner end thereof, the diameter of the cable and the inner diameter of the tube being such that polyurethane resin fills the space between the tube and the cable during the molding process, locking the cable into the tube;

the bat being flexible and resilient at the intermediate portion and permitting the bat to bend resiliently at the end of the swing so as to cushion the change in momentum of the weighted outer portion of the bat, minimizing muscle stress on the person swinging the bat without detracting from the weight training.

7. A warm-up device for use in Connection with a sport wherein an elongated implement is swung to hit a ball or the like, the device comprising:

an elongated body integrally molded from a resilient, moldable plastic resin, the device including an elongated handle portion extending outwardly from an inner end of the device towards an outer portion adjacent the outer end of the device;

a weight integrally molded in the outer portion of the device;

an elongated stiffener integrally molded in the handle portion of the device, the stiffener extending from an inner end adjacent the inner end of the device to an outer end spaced apart from the weight by a predetermined distance, leaving an intermediate portion of the device between the stiffener and the weight, the stiffener causing the handle portion surrounding the stiffener to be substantially more rigid than the intermediate portion, the intermediate portion being resilient and flexible such that when the device is swung, the device resiliently bends and causes the weighted outer portion to gradually decelerate at the end of the swing, thus cushioning momentum and minimizing damaging muscle stress on the person swinging the weighted device while still providing weight training and flexibility exercise, the device bending about 70 to 110 degrees at the end of a swing, the length of the intermediate portion and the thickness and durometer of the device at the intermediate portion being such that the resin resiliently restrains the device to a gradual bend at the end of a swing to cushion the change in momentum of the weighted outer portion; and a connector cable interconnecting the stiffener and the weight, the cross sectional area of the intermediate portion and the resilience of the intermediate portion being provided primarily by the plastic resin of the body.

8. A warm-up device according to claim 7 wherein the device is a bat and weighs at least about three (3) pounds.

9. A warm-up device according to claim 7 wherein the device is a tennis racquet.

10. A warm-up device according to claim 7 wherein the device is integrally formed of molded polyurethane having a durometer of 60–90.

11. A warm-up device according to claim 9 wherein the device is integrally formed of molded polyurethane having a durometer of 80–85.

12. A warm-up device according to claim 7 wherein the device is a golf club.

13. A warm-up device according to claim 12 wherein the device is integrally formed of molded polyurethane having a durometer at the intermediate portion of about 85–95.

14. A warm-up device according to claim 13 wherein the polyurethane surrounding the cable is at least about ¼ inch thick at the intermediate portion.

15. A warm-up device according to claim 12 wherein the device is integrally formed of molded polyurethane having a durometer at the intermediate portion of about 90–95.

* * * * *